US006779532B2

(12) United States Patent
Dorf

(10) Patent No.: US 6,779,532 B2
(45) Date of Patent: Aug. 24, 2004

(54) COSMETIC BRUSH FOR APPLYING EYELINER TO THE LASHLINE

(75) Inventor: Paula Dorf, New York, NY (US)

(73) Assignee: Paula Dorf Cosmetics, New York, NY (US)

( * ) Notice: Subject to any disclaimer, the term of this patent is extended or adjusted under 35 U.S.C. 154(b) by 0 days.

(21) Appl. No.: 09/753,238

(22) Filed: Dec. 28, 2000

(65) Prior Publication Data

US 2002/0083953 A1 Jul. 4, 2002

(51) Int. Cl.[7] ..... A45D 24/00
(52) U.S. Cl. ..... 132/200
(58) Field of Search ..... 132/216, 217, 132/218, 317, 320, 200, 208; D28/7, 36; 15/160, DIG. 5, DIG. 6, 192, 191.1, 193; D4/135

(56) References Cited

U.S. PATENT DOCUMENTS 1,905,399 A * 4/1933 Wagner ..... 15/160
3,343,552 A * 9/1967 Steffen ..... 132/320
4,222,677 A * 9/1980 Cervantes ..... 401/129
D258,240 S * 2/1981 Takada et al. ..... D28/7
4,998,315 A * 3/1991 Pessis ..... 15/160
5,062,672 A * 11/1991 Harris ..... 294/65.5
5,205,301 A * 4/1993 Nakamura ..... 132/320
5,357,647 A * 10/1994 Gueret ..... 15/159.1
5,450,865 A * 9/1995 Park ..... 132/218
5,765,573 A * 6/1998 Gueret ..... 132/218
6,026,823 A * 2/2000 Gueret ..... 132/218
6,039,051 A * 3/2000 Dorf ..... 132/313
6,176,631 B1 * 1/2001 Gueret ..... 401/129
D450,931 S * 11/2001 Mink et al. ..... D4/135

* cited by examiner

*Primary Examiner*—Kevin Shaver
*Assistant Examiner*—David Comstock
(74) *Attorney, Agent, or Firm*—Ward & Olivo

(57) ABSTRACT

The invention provides for a makeup brush for facilitating the application of eyeliner to the upper lashline of the eyes. The brush comprises a tuft of bristles configured in a curved pattern to conform to the contour of the eyelid. The overall width of the brush head, in combination with the curvature of the tuft, provide a brush which facilitates the accurate and natural-looking application of eyeliner. Specifically, the curved design of the bristles of the brush are such that eyeliner may be applied between the lashes of the lashline, rather than merely above or below the lashline.

17 Claims, 3 Drawing Sheets

COSMETIC BRUSH FOR APPLYING EYELINER TO THE LASHLINE

TECHNICAL FIELD OF THE INVENTION

The present invention relates to an improved applicator for makeup. More specifically, the invention relates to a brush designed for efficient and consistent application of liquid eyeliner to the eyelids. A preferred embodiment of such a brush has a configuration of bristles positioned in a shape designed to both compliment the naturally occurring shape of the eye and to provide an even, consistent and symmetrical distribution of eyeliner.

BACKGROUND OF THE INVENTION

To achieve a smooth, even, and natural-looking application of eyeliner, it is necessary to carefully apply the cosmetic such that the proper amount is applied in an even distribution, which is equally balanced between the left and right eyes.

A common problem with conventional brushes is that they result in the over-application of makeup. When an excess amount of cosmetic is applied, this results in a very unnatural look which is undesirable. In particular, eyeliner is intended to enhance and accentuate the natural shape of the eyes, and its over-application therefore nullifies its purpose.

The ideal eyeliner application will define the eyes by lending color and shape to the lashline. Conventionally, various types of applicators have been used to apply eyeliner, including a variety of bristled brushes having different widths, sponge-like applicators, pen- or pencil-like applicators, or even fingers. However, all of these have practical disadvantages, including, for example, uneven or imprecise application of the cosmetic, and irregular draw line width.

Currently, brush type eyeliner applicators are comprised of felt tips, foam applicators, or straight fibers and bristles. The bristles are typically arranged in a straight line fashion to allow linear application of cosmetic along the plane of the face.

Examples of such brush type eyeliner applicators are disclosed in Nehashi, U.S. Pat. No. 5,097,853 (disclosing a felt tip applicator) and Nakamura, U.S. Pat. No. 5,205,301 (disclosing an applicator with straight natural or synthetic fiber bristles.) Nehashi discloses an applicator designed specifically for the eye, whereby a felt tip is inserted into a material soaked with cosmetic, and then the cosmetic is applied to the face via the felt tip. The patent discloses a felt tip with a tapering end.

Nakamura discloses an applicator for cosmetics with straight fibers wherein the applying tip comprises a flat end. The bristles are arranged in a straight line, for applying cosmetic to the skin in a uniform linear manner.

Prior to the present invention, there has not been an eyeliner brush designed to conform to the natural shape of the eye, so that eyeliner makeup can be applied in a manner such that the proper quantity is applied with an even, uniform distribution around the contours of the eye.

SUMMARY OF THE INVENTION

The invention described herein relates to a brush specifically designed to deposit eyeliner in a manner that exactly corresponds to the shape of the eyelid. The brush is designed to ease the application of makeup to the eye by placing the bristles in such a manner that the wearer need not force said bristles to unnaturally follow the shape of the eye during application of eyeliner.

In light of the above described inadequacies in conventional applicators of eyeliner, it is a primary object of the invention described herein to provide an eyeliner brush that allows for improved application of eyeliner to the upper lashline of the eyes.

It is another object of the invention to provide a brush designed such that it may also perform the functions of conventional applicators.

It is a further object of the invention to provide an eyeliner brush having a curved or arched design such that it allows for application of eyeliner between individual lashes of the upper lashline of the eyes.

It is yet a further object of the invention to provide an eyeliner brush having a curved or arched design such that it may be used in a "position and wiggle" manner to apply eyeliner between individual lashes of the eyelashes.

It is yet another object of the invention to provide an eyeliner brush that allows for easier and more even application of eyeliner.

It is still another object of the invention to provide an eyeliner brush which facilitates more accurate application of eyeliner by conforming more closely to the contour of the eye.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF THE PREFERRED EMBODIMENT

As required, a detailed illustrative embodiment of the present invention is disclosed herein. However, techniques, systems and operating structures in accordance with the present invention may be embodied in a wide variety of sizes, shaped, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

The following provides a detailed description of the preferred embodiment of the present invention, as well as some alternative embodiments of the invention. As discussed above, the present invention relates generally to a device for the application of eyeliner. Reference is herein made to the figures, wherein the numerals representing particular parts are consistently used throughout the figures and accompanying discussion.

Figure 1:
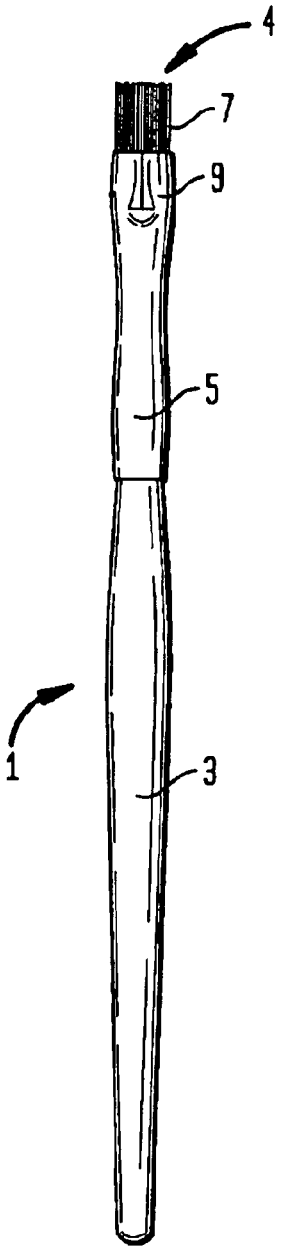
FIG. 1 depicts a top plan view of an eyeliner brush according to the preferred embodiment of the present invention.

Referring initially to FIG. 1, shown is the preferred embodiment of eyeliner brush 1 comprising a handle 3, ferrule 5, and tuft 7, further comprising a plurality of bristles 4. Bristles 4 generally extend longitudinally away from ferrule 5 in a substantially parallel direction. Preferably, bristles 4 are configured such that tuft 7 has a tip portion having a curved shape so as to conform to the shape and contour of the eye. This curved shape is better depicted in FIG. 4. As shown, tuft 7 is curved with respect to ferrule 5, which is described in further detail below. Turning back to FIG. 1, bristles 4 are connected within the upper portion of ferrule 5. Preferably, bristles 4 are attached to ferrule 5 by crimping ferrule 5 at point 9 (FIG. 2) which exerts sufficient pressure by ferrule 5 on bristles 4 to secure bristles 4 therein. This is better shown in FIG. 2 at indentation 9, where bristles 4 are "clamped" into ferrule 5. Alternatively, bristles 4 may be secure within ferrule 5 by use of a conventional adhesive. Of course, any other conventional means for securing bristles 4 within ferrule 5 may be used in accordance with this invention, either alone or in combination with one or more other securing means.

Alternatively, tuft 7 may be attached to ferrule 5 by crimping one end of ferrule 5 to enclose said bristles 4 in manner that forces bristles 4 to arrange themselves in a direction conducive to the application of an eye-makeup product. In a preferred embodiment, ferrule 5 is crimped to arrange bristles 4 in a contoured semicircle shape. In other embodiments, ferrule 5 can be crimped to arrange bristles 4 into a contoured oval, round, square, rectangular, triangular, or other shapes to facilitate the application of makeup.

Preferably, ferrule 5 is made of metal. Such common metals include tin, steel, nickel, aluminum, or any alloy thereof. Additionally, ferrule 5 may be constructed from a plastic having suitable flexible properties. Furthermore, while ferrule 5 has been shown and described as similar to conventional ferrules for attaching bristles to the handle of a brush, other means for attaching tuft 7 to handle 3 of a brush 1 is contemplated as being encompassed by the present invention.

On its lower end ferrule 5 is secured to handle 3. Again, any conventional means for securing ferrule 5 to handle 3 may be used (i.e. adhesive, press fitting, etc.).

Preferably, handle 3 is made of wood, allowing for an inexpensive, light weight, more easily finished, and more durable cosmetic brush. In alternative embodiments, handle 3 may be constructed from plastics or metals such as aluminum, tin, and alloys thereof, ceramic, or any other material suitable for a makeup brush handle.

In the preferred embodiment shown in the figures, handle 3 is generally cylindrical having a tapered end and an attachment end. In alternative embodiments, the shape of handle 3 may vary. Such shapes include square or triangular, or tapered or straight, etc. Further, handle 3 may be constructed with indentations (or grooves) or raised elements around its circumference for easier grip. Alternatively, handle 3 may have longitudinal grooves along the handle, or an ornamental or functional object at its tapered end, or some other device or configuration adapted to facilitate as well as provide comfort while holding eyeliner brush 1 during use.

Figure 2:
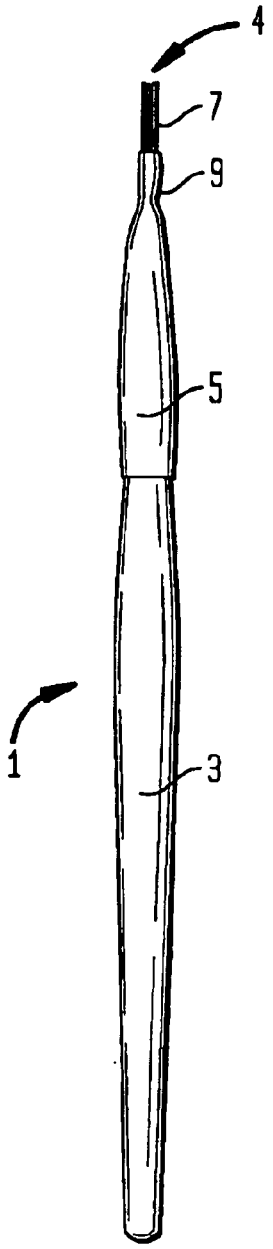
FIG. 2 shows a side view of the eyeliner brush depicted in FIG. 1.

Referring next to FIG. 2, shown is a side view of the preferred embodiment of eyeliner brush 1 according to the present invention. As described above with respect to FIG. 1, brush 1 comprises tuft 7 of bristles 4 attached within ferrule 5 which is connected to handle 3. More particularly, shown in FIG. 2 is the specific shape and contour of the preferred embodiment of eyeliner brush 1. As shown, bristles 4 extend from ferrule 5 in a contoured semi-circular shape. That is, ferrule 5 at its upper end maintains a curved shape, which defines the shape of bristles 4. Also, as shown, ferrule 5 may be crimped as indicated by indentation 9 to secure bristles 4 in ferrule 5. In alternate embodiments, ferrule 5 may maintain different shapes to achieve different contour shapes for tuft 7. For example, ferrule 5 may have an angled shape rather than the curved shape as shown in the figures. The desired shape is determined by the purpose for which the brush will be used.

Figure 3:
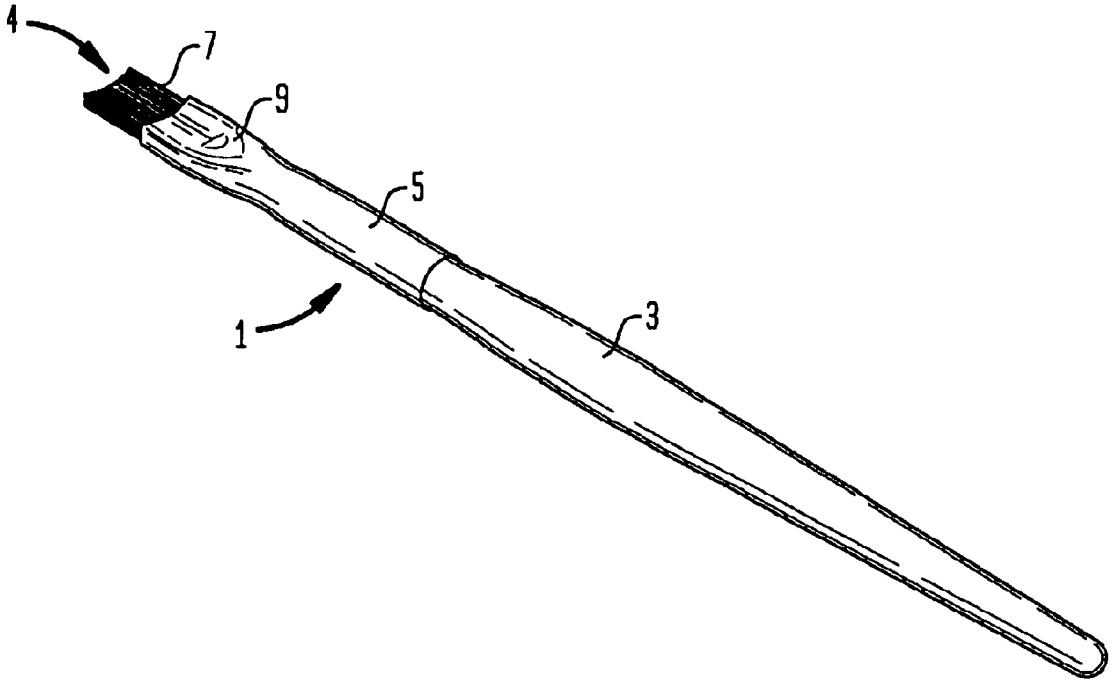
FIG. 3 shows a perspective view of the eyeliner brush depicted in FIG. 1.

Turning next to FIG. 3, shown is a perspective view of the preferred embodiment of eyeliner brush 1 depicted in FIG. 1, further emphasizing the preferred structure of eyeliner brush 1 according to the present invention. Again, shown is ferrule 5 crimped at indentation 9 to secure tuft 7 in such a way as to arrange bristles 4 in a semi-circular contoured shape. Also, ferrule 5 is attached at its lower end to handle 3, as described above with respect to FIG. 1.

Figure 4:
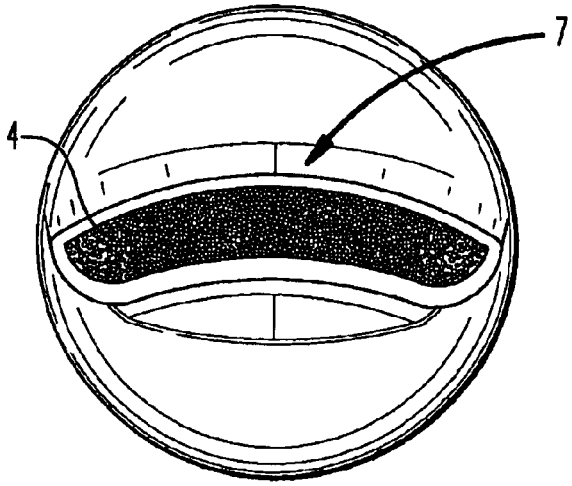
FIG. 4 shows an enlarged end view of the eyeliner brush depicted in FIG. 1.

Referring finally to FIG. 4 shown is an enlarged end view of tuft 7 according to the preferred embodiment of the present invention. In particular, FIG. 4 demonstrates the general placement of individual bristles 4 within tuft 7, further depicting the curved (or arched) structure of tuft 7, which more closely conforms to the contour of the eye than previous applicators or brushes. In addition, it is preferred that bristles 4 all be the same length such that the tip portion of tuft 7 is substantially flat along its top edge. Alternatively, bristles 4 may vary in length such that the tip portion of tuft 7 is substantially curved, or is substantially angled such that the tip portion comes to a point. In alternative embodiments, bristles 4 may be configured such that tuft 7 maintains a substantially curved shape to conform to the contours of the eye. In further alternative embodiments, the length of individual bristles may vary. This variation of bristle length across the width of the tuft can provide a curved shape of the tuft, briefly described above. However, it should be noted that the bristles are not necessarily formed so that the lengths are uniformly varied. That is, adjacent bristles may vary greatly in length. This gives the tuft a softer feel across the skin and allows for smoother application of the cosmetic across the contour of the face. Alternatively, however, these embodiments may also be used along with the alternative structures of ferrule 5 described herein.

Figure 5:
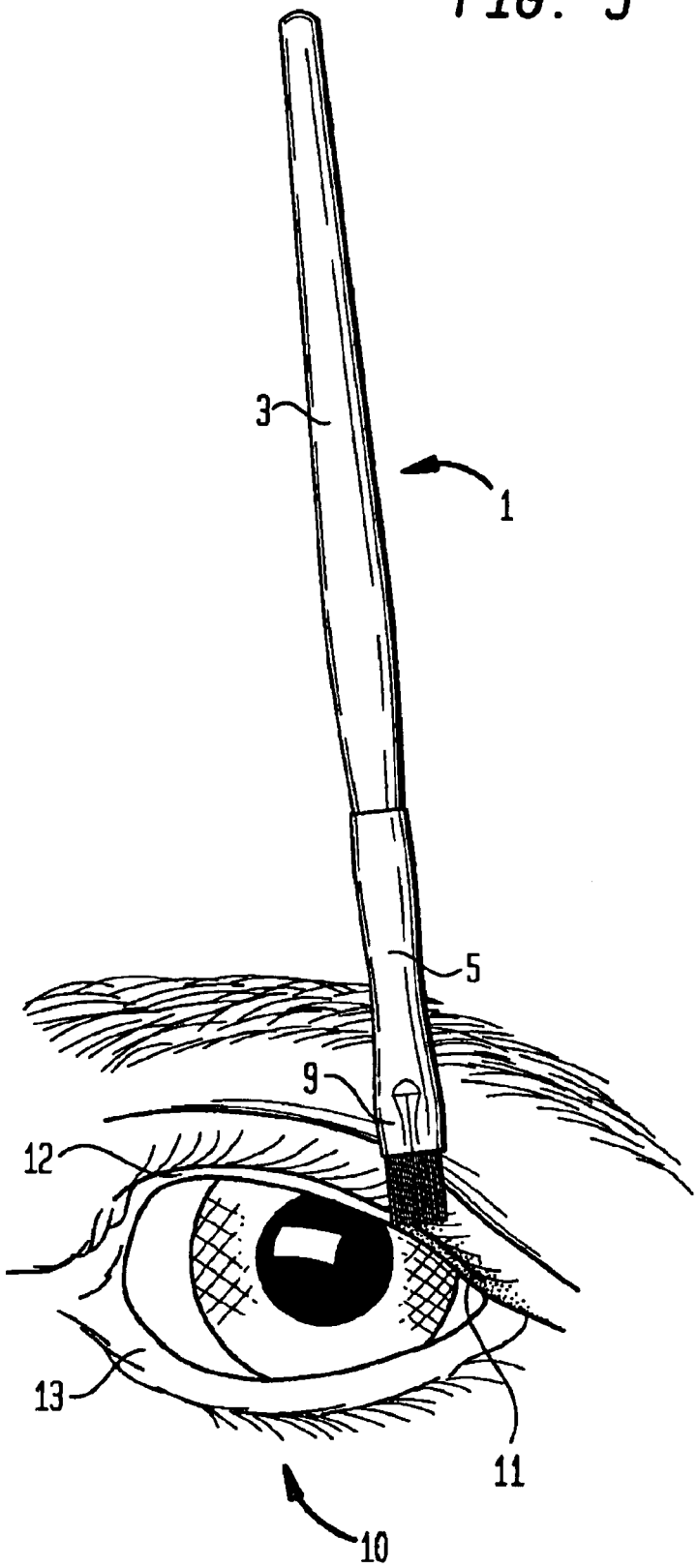
FIG. 5 shows a view of the eye with cosmetic partially applied across the lashed of the eyelid with a brush according to the present invention.

With respect to FIG. 5, shown is a view of the eye with make-up 11 applied part way across the lashbed 12 of the eye 10 by the brush 1 of the present invention. Specifically, FIG. 5 demonstrates the "position and wiggle" application of make-up 11 to the lashbed 12. Also, in an alternative embodiment the cosmetic may be applied along the lower lashbed 13 of the eye although this may not be desirable.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and principles of the invention. It should be appreciated that the present invention is capable of being embodied in other forms without departing from its essential characteristics.

What is claimed is:

1. A method of applying eyeliner to the lashbed of the eyelids, said method comprising the steps of:

applying cosmetic to a tip end of a tuft of bristles of a brush comprising:

a handle having a grip end and an attachment end;

a ferrule having a first end and a second end; and a tuft of bristles, said bristles forming a root end and a tip end of said tuft;

wherein said ferrule secures said handle to said root end of said tuft; wherein said first end of said ferrule is attached to said attachment end; wherein said root end is attached at said second end of said ferrule; wherein said tuft has a pre-determined cross-section defined by a width and a thickness; and wherein said bristles are aligned such that said bristles in a direction along said width form a generally curved shape, such that said tuft at said tip end is arcuately shaped, and said thickness is substantially uniform along said arcuate shape;

firmly positioning said tip end sequentially on a plurality of locations on said lashbed such that said generally curved shape of said tip end meets the skin of said lashbed; and moving said tip end in a side-to-side motion on each said location such that said cosmetic is applied to said lashbed between, above and/or below individual lashes at said location.

2. A method according to claim 1, wherein said plurality of bristles have substantially the same lengths.

3. A method according to claim 1, wherein said width is greater than or equal to twice said thickness.

4. A method according to claim 1, wherein said predetermined cross-section is semi-elliptical.

5. A method according to claim 1, wherein said handle is tapered.

6. A method according to claim 1, wherein said handle is constructed from a metal.

7. A method according to claim 1, wherein said metal is selected from the group consisting of aluminum, steel, tin, and an alloy of tin.

8. A method according to claim 1, wherein said handle is constructed from wood.

9. A method according to claim 1, wherein said handle is constructed from plastic.

10. A method according to claim 1, wherein said handle is constructed from bamboo.

11. A method according to claim 1, wherein said ferrule is constructed from a metal.

12. A method according to claim 11, wherein said metal is selected from the group consisting of tin, steel, aluminum and an alloy of tin.

13. A method according to claim 1, wherein said ferrule is constructed from plastic.

14. A method according to claim 1, wherein said bristles comprise fibrous strands.

15. A method according to claim 14, wherein said fibrous strands comprise synthetic nylon.

16. A method according to claim 14, wherein said fibrous strands comprise hair.

17. A method according to claim 14, wherein said fibrous strands comprise hair and synthetic nylon.

* * * * *